US007600846B2

(12) United States Patent
Hatakenaka

(10) Patent No.: US 7,600,846 B2
(45) Date of Patent: Oct. 13, 2009

(54) ACCUMULATED-HEAT CORRECTION APPARATUS AND ACCUMULATED-HEAT CORRECTION METHOD FOR THERMAL HEAD

(75) Inventor: Takashi Hatakenaka, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 335 days.

(21) Appl. No.: 11/652,062

(22) Filed: Jan. 11, 2007

(65) Prior Publication Data

US 2008/0001984 A1 Jan. 3, 2008

(30) Foreign Application Priority Data

Feb. 7, 2006 (JP) ..... 2006-029640

(51) Int. Cl.
*B41J 29/393* (2006.01)

(52) U.S. Cl. ..... 347/19

(58) Field of Classification Search ..... 347/9–11, 347/19, 12, 15, 41

See application file for complete search history.

(56) References Cited

U.S. PATENT DOCUMENTS 5,235,345 A 8/1993 Ohno et al.

5,623,297 A 4/1997 Austin et al.

FOREIGN PATENT DOCUMENTS

| | | | |
|---|---|---|---|
| JP | 6-79901 | A | 3/1994 |
| JP | 2003-251844 | A | 9/2003 |
| JP | 2004-50563 | A | 2/2004 |
| KR | 10-0380104 | B1 | 8/2003 |
| WOWO-PCT/ | US97/00147 | A | 7/1997 |

*Primary Examiner*—Lamson D Nguyen
(74) *Attorney, Agent, or Firm*—Birch, Stewart, Kolasch & Birch, LLP

(57) ABSTRACT

An accumulated-heat correction apparatus for a thermal head, wherein print data of each line are outputted to the thermal head, and a conduction time of the thermal head is controlled on the basis of the print data, includes cumulative-data calculation means for calculating cumulative data which is ascribable to accumulated heat of the thermal head up to a previous line (n−1), next-line data calculation means for calculating print data of a next line (n+1), correction-data generation means for calculating correction data (ΔTs) which corrects print data of a current line n, by using the cumulative data and the next-line data, and head control means for controlling the conduction time of the thermal head on the basis of the correction data (ΔTs) which has been generated by the correction-data generation means.

4 Claims, 7 Drawing Sheets

THERMAL - HEAD CONDUCTION TIME
0
tn - 1
tn
tn + 1
tn + 2

THERMAL - HEAD TEMPERATURE
ACCUMULATED HEAT A
ACCUMULATED HEAT B

PRINT OUTPUT
(n - 1) TH LINE
nTH LINE
(n + 1) TH LINE

ACCUMULATED-HEAT CORRECTION APPARATUS AND ACCUMULATED-HEAT CORRECTION METHOD FOR THERMAL HEAD

BACKGROUND OF THE INVENTION

1. Field of the Invention

This invention relates to an accumulated-heat correction apparatus and an accumulated-heat correction method for the thermal head of a thermosensitive printer, a thermosublimation printer or the like.

2. Description of the Related Art

A prior-art accumulated-heat correction method of the type specified above will be described in due course.

FIGS. 6A-6C are conceptual diagrams in the case where accumulated heat is not corrected.

FIG. 6A shows a thermal-head conduction time. Usually, a thermal head comes to have a heat quantity corresponding to the conduction time. FIG. 6B shows a thermal-head temperature corresponding to the thermal-head conduction time in FIG. 6A. Usually, the density of a print is obtained in correspondence with the temperature of the thermal head. FIG. 6C exemplifies a print output generated by the thermal-head conduction time in FIG. 6A, and the central part thereof shows the states of the print densities. The conduction time of the (n−1)th line is $t_{n-1}$, that of the nth line is $t_n$, and that of the (n+1)th line is $t_{n+1}$.

Referring to FIG. 6A, the conduction time $t_{n-1}$ of the (n−1)th line and the conduction time $t_n$ of the nth line have an identical value $t_{n-1}=t_n$. However, heat is accumulated in the thermal head, so that when a current is conducted through the thermal head for equal time periods, a temperature rise corresponding to accumulated heat A occurs at the nth line as shown in FIG. 6B.

That is, notwithstanding that the (n−1)th line and the nth line are intended to be printed at an identical density, the density of the nth line becomes higher than that of the (n−1)th line in correspondence with the accumulated heat A on account of the heat accumulation of the thermal head.

Likewise, at the (n+1)th line, the conduction time is decreased to $t_{n+1}$ with the intention of a print which does not develop any color, but an intended print density is not attained on account of residual heat corresponding to an accumulated heat B.

Next, a prior-art example in which accumulated heat is corrected is shown in FIGS. 7A-7C.

In the correction of the nth line in FIGS. 7A-7C, the conduction time of the nth line is decreased in correspondence with a correction A in FIG. 7A in order that the accumulated heat A of the nth line as shown in FIG. 6B may not incur the temperature rise.

The conduction time $t_n$ in FIG. 7A is obtained by subtracting the component of the correction A from the ordinary conduction time. Thus, as shown in FIG. 7B, the temperatures (or heat quantities) of the thermal head become substantially identical at the (n−1)th line and the nth line, and the intended density of the nth line is attained, so that the accumulated-heat correction is successfully made.

Likewise, in the correction of the (n+1)th line, the conduction time of the (n+1)th line is subtracted in correspondence with the accumulated heat B in FIG. 6B, whereby an accumulated heat quantity is corrected, and an intended print density is attained.

That is, the prior art is the accumulated-heat correction method which is schemed to attain the intended print density, in such a way that the accumulated heat quantity is predicted from data for which a current is to be conducted, and preceding data, whereupon the accumulated-heat correction is applied (refer to, for example, JP-A-2004-050563 and JP-A-2003-251844).

When the conduction time for the (n+1)th line is to be corrected by the prior-art accumulated-heat correction method as stated above, the accumulated heat B remaining at the (n+1)th line as indicated in FIG. 6B must be corrected. However, when the conduction time of the thermal head is to be subtracted as indicated at a correction B in FIG. 7A, it becomes less than zero. Since the conduction time does not become less than zero, a correction magnitude at the (n+1)th line becomes a correction B'.

That is, a correction magnitude is short by (the correction B− the correction B') for the (n+1)th line, and the intended print density of the (n+1)th line cannot be attained.

Concretely, the prior art has had the problem that, although the density at which any color is not developed is intended for the (n+1)th line, the accumulated-heat correction cannot be fully made, resulting in a print density at which a color is somewhat developed.

SUMMARY OF THE INVENTION

This invention has been made in order to eliminate the problem as stated above, and it has for its object to provide an accumulated-heat correction apparatus and an accumulated-heat correction method for a thermal head for accurately reproducing a desired print density.

This invention concerns an accumulated-heat correction apparatus for a thermal head, wherein print data of each line are outputted to the thermal head, and a conduction time of the thermal head is controlled on the basis of the print data. In the accumulated-heat correction apparatus, cumulative-data calculation means calculates cumulative data which is ascribable to accumulated heat of the thermal head up to a previous line. Next-line data calculation means calculates print data of a next line. Correction-data generation means calculates correction data which corrects print data of a current line, by using the cumulative data and the next-line data. Further, head control means controls the conduction time of the thermal head on the basis of the correction data which has been generated by the correction-data generation means.

In addition, this invention concerns an accumulated-heat correction method for a thermal head, wherein print data of each line are outputted to the thermal head, and a conduction time of the thermal head is controlled on the basis of the print data. In the accumulated-heat correction method, cumulative data which is ascribable to accumulated heat of the thermal head up to a previous line is calculated, and also print data of a next line is calculated. Correction data which corrects print data of a current line is calculated by using the cumulative data and the next-line data. Further, the conduction time of the thermal head is controlled on the basis of the correction data.

According to the accumulated-heat correction apparatus and the accumulated-heat correction method for the thermal head in this invention, the data of the next line is also considered in the portion of the accumulated-heat calculation. Thus, in a case where the accumulated heat of the next line cannot be corrected, the correction is applied to the current line, whereby a desired print density is attained, and a print which has a high image quality as a whole can be obtained.

The foregoing and other objects, features, aspects, and advantages of this invention will become more apparent from the following detailed description of this invention when taken in conjunction with the accompanying drawings.

DESCRIPTION OF THE PREFERRED EMBODIMENT

Figure 1:
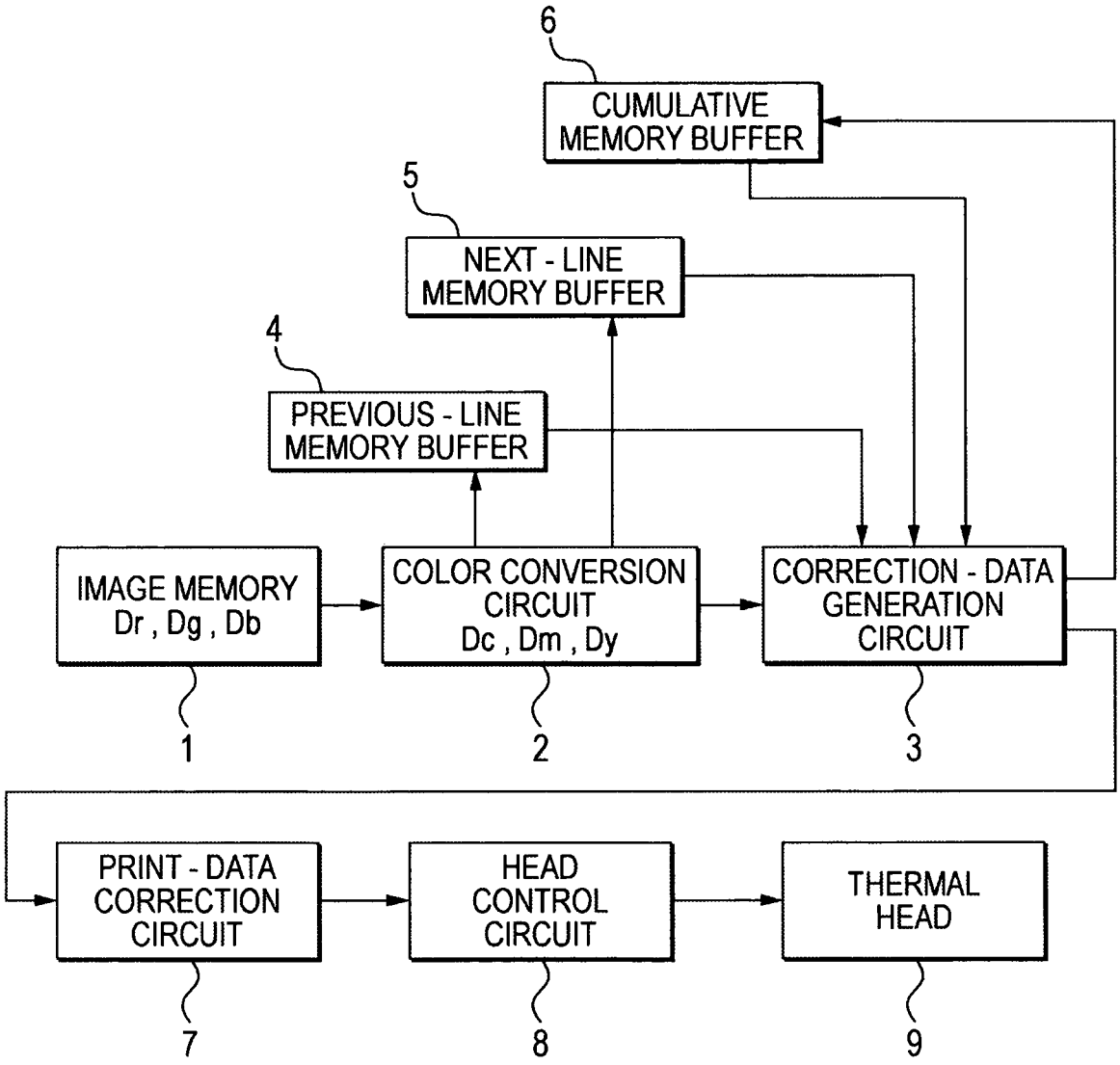
FIG. 1 is a block circuit diagram showing an embodiment of this invention.
Figure 2:
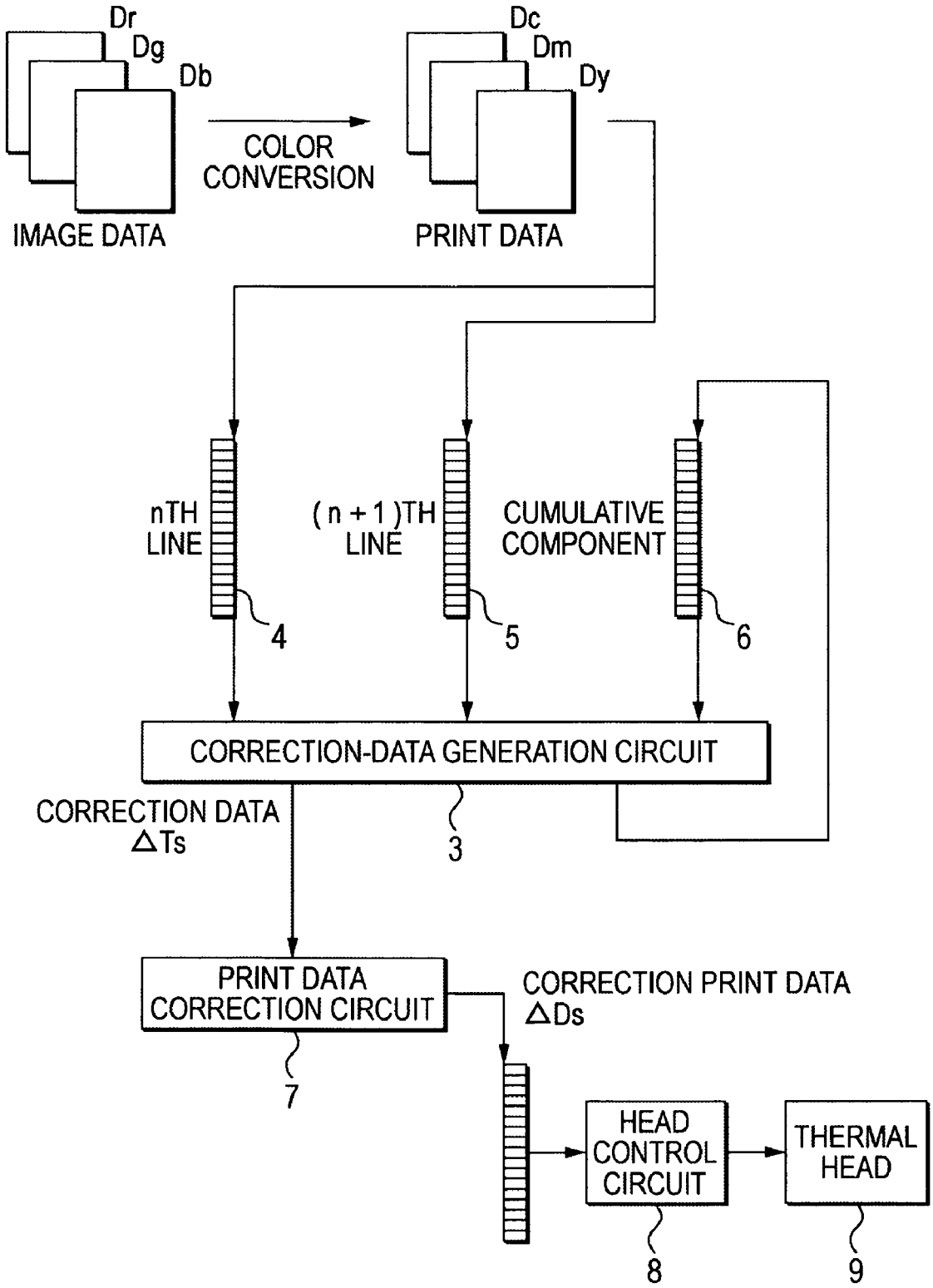
FIG. 2 is a diagram showing the flow of an accumulated-heat correction process based on block circuits in FIG. 1.

FIG. 1 is a block circuit diagram showing an embodiment of this invention, FIG. 2 is a diagram showing the flow of an accumulated-heat correction process based on block circuits in FIG. 1, and FIGS. 3A-3C are conceptual diagrams showing an accumulated-heat correction method according to the embodiment.

Referring to FIG. 1, an image memory 1 receives image data Dr, Dg and Db of respective colors R, G and B from an external computer or the like. A color conversion circuit 2 converts the image data Dr, Dg and Db of the respective colors into print data Dc, Dm and Dy of respective colors C, M and Y, and it stores these print data Dc, Dm and Dy in a current memory buffer 4.

In addition, at this point of time, cumulative data up to a previous line (n−1) are stored in a cumulative memory buffer 6, and print data of next line (n+1) is stored in a next memory buffer 5.

A correction-data generation circuit 3 reads out the print data at a current line n, from the current memory buffer 4, the cumulative data up to the previous line (n−1), from the cumulative memory buffer 6, and the print data at the next line (n+1), from the next memory buffer 5, respectively. Besides, the correction-data generation circuit 3 processes these print data on the basis of a predetermined calculation formula, thereby to calculate correction data ΔTs for correcting the print data of the current line n. Here, in calculating the correction data ΔTs of the current line n, the correction-data generation circuit 3 predicts a correction magnitude at the next line (n+1), and it adjusts the correction data ΔTs of the current line n in a case where the predictive value is greater than the maximum of an available conduction time or less than the minimum thereof.

A print-data correction circuit 7 adds the correction data ΔTs of the current line n as calculated by the correction-data generation circuit 3, to the print data of the current line n, thereby to calculate correction print data ΔDs.

A head control circuit 8 reads out the correction print data ΔDs of each individual line from the print-data correction circuit 7, and it generates predetermined thermal energy by conducting a current through the individual heat generation elements of a thermal head 9 on the basis of the correction print data ΔDs, thereby to form an image of predetermined density on a record sheet every line.

Figures 3A, 3B, 3C:
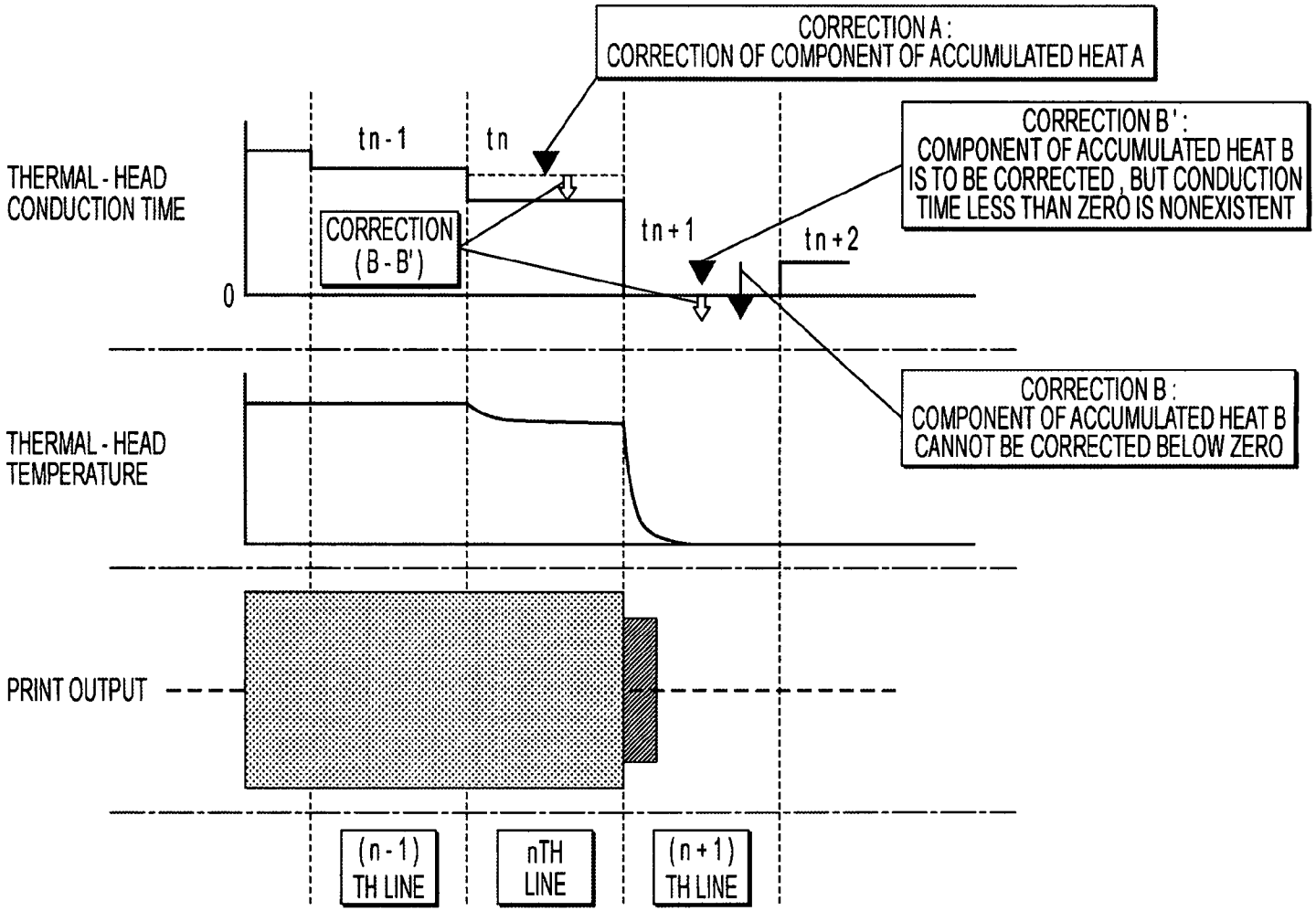
FIGS. 3A-3C are conceptual diagrams showing an accumulated-heat correction method according to the embodiment.

FIGS. 3A-3C show conceptual diagrams of an accumulated-heat correction calculation according to the embodiment of this invention.

In the figures, FIG. 3A shows the conduction time of the thermal head, FIG. 3B shows the temperature of the thermal head, and FIG. 3C shows an example of a print output.

The print data of the (n+1)th line is read out at the nth line in FIGS. 3A-3C, by the correction-data generation circuit 3. In a case where a conduction time for the value of the print data is greater than the maximum of the available conduction time or less than the minimum thereof, a correction accumulated-heat magnitude corresponding to (a correction magnitude B− a correction magnitude B') which cannot be corrected is subtracted from the conduction time of the nth line, thereby to remove the uncorrectable component of the (n+1)th line.

Owing to such an accumulated-heat correction, as shown in FIG. 3C, an intended density can be attained at the (n+1)th line having been uncorrectable, though the density of the nth line fluctuates to some extent.

Both the nth line and the (n+1)th line are permitted to attain intended print densities by adjusting the magnitude of reflection on the nth line.

Figure 4:
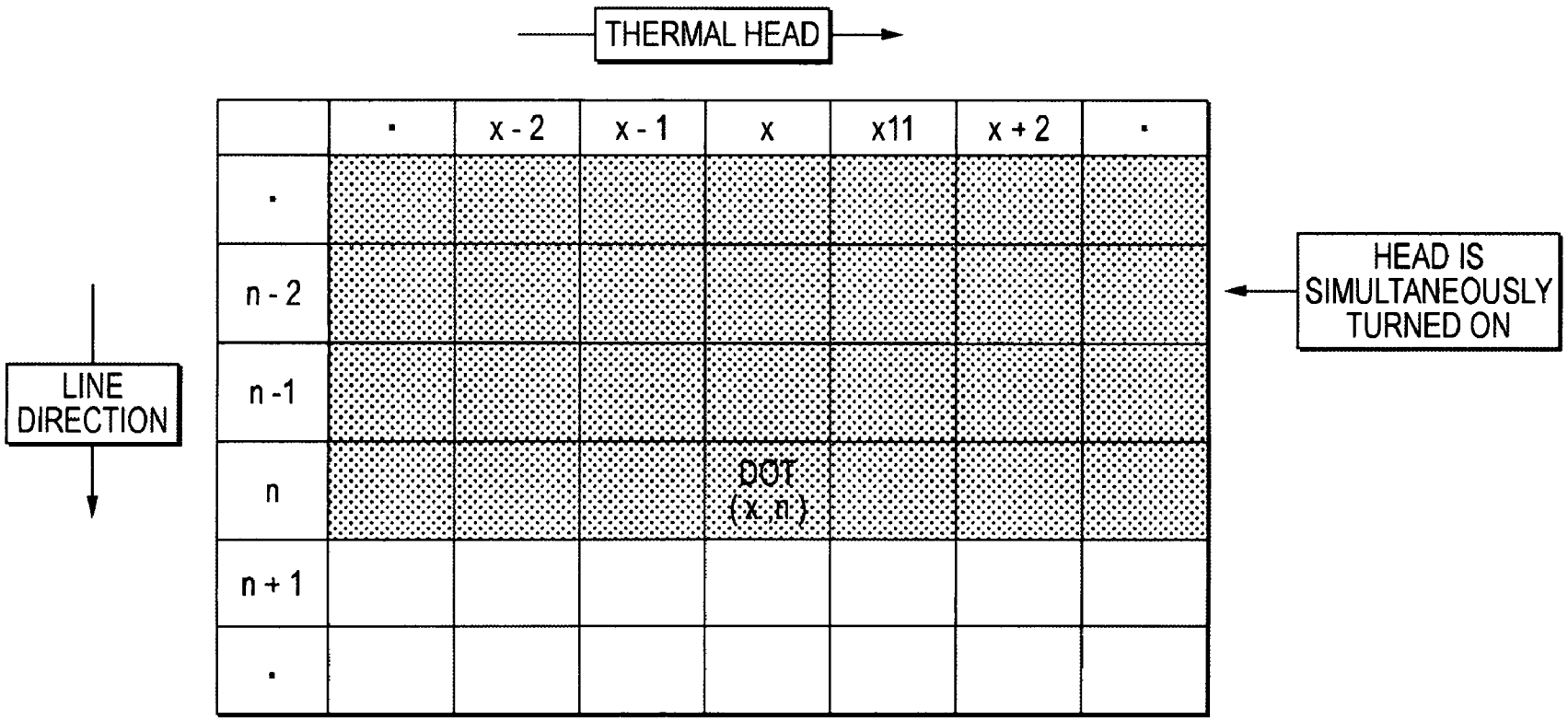
FIG. 4 is a model diagram for explaining the accumulated-heat correction method according to the embodiment, in comparison with the prior art.

Further, FIG. 4 is a model diagram for explaining the accumulated-heat correction method according to the embodiment of this invention, in comparison with the prior art.

In the case of the prior art, ordinarily the thermal head is turned ON simultaneously for individual dots at the nth line, and the density of a print is attained in the ON time period of the individual dots. Here, an accumulated heat quantity up to the (n−1)th line and the accumulated heat quantity of the lateral dots of a print dot are corrected in the ON time period of the head.

Let's consider the correction of a dot DOT (x, n) at the nth line as shown in FIG. 4. It is assumed that an image to be printed is, for example, 8-bit data which has 128 gradations (0: white/128: gray/255: black), and that the ON time period of the thermal head becomes 0.5 msec (0.1 msec: white/0.5 msec: gray/1.0 msec: black) (it is assumed that one line is printed in 2 msec). Then, when the thermal head is turned ON for 0.5 msec, the dot DOT (x, n) ought to become gray, but it is actually influenced by the surroundings.

In a case, for example, where a dot DOT (x, n−1) is black, the dot DOT (x, n−1) is turned ON for 1 msec and turned OFF for 1 msec at the (n−1)th line (because one line is assumed to be of 2 msec), whereupon the turn-ON of the dot DOT (x, n) is started. On this occasion, if the head temperature has lowered to the original temperature in the OFF period of 1 msec, the dot DOT (x, n) becomes gray by the turn-ON of 0.5 msec, but if not, the dot DOT (x, n) becomes denser than the ordinary gray by the turn-ON of 0.5 msec. The same holds true of left and right dots which are simultaneously turned ON. In a case where the adjacent dots DOT (x−1, n) and DOT (x+1, n) are printed in black, also the dot DOT (x, n) is influenced by heat.

In this manner, the prior art controls the ON time period of the nth line and controls the heat generation quantity thereof in consideration of the accumulated heat quantity before the nth line and the influences of the adjacent dots to-be-turned-ON. Disadvantageously, however, the ON time period cannot be set less than zero or in excess of a line rate.

This invention eliminates the disadvantage. In case of controlling the ON time period of the dot DOT (x, n), the same calculation as in the prior art is executed, and the same calculation is thereafter executed for a dot DOT (x, n+1) on the basis of the input data of the (n+1)th line. Even in a case where the calculated result of the dot DOT (x, n+1) becomes a (−)

time period, the ON time period does not become less than zero at the dot DOT (x, n+1), so that the print time period of the preceding dot DOT (x, n) is subtracted. The subtraction of the print time period of the dot DOT (x, n) assists in the correction of the next line.

Figure 5:
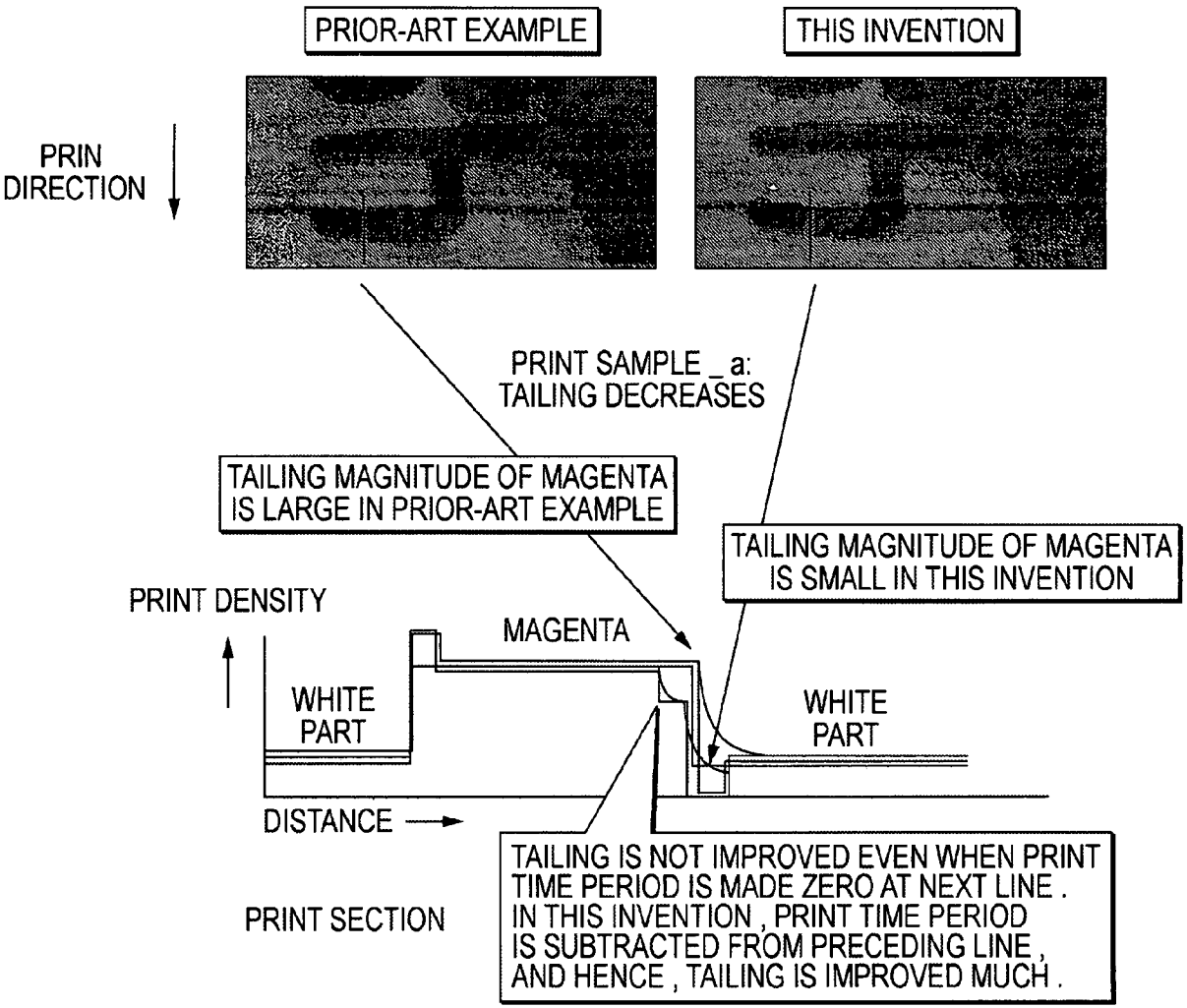
FIG. 5 is an explanatory diagram showing a print area obtained by the accumulated-heat correction method according to the embodiment, in comparison with a prior-art example.
Figures 6A, 6B, 6C:
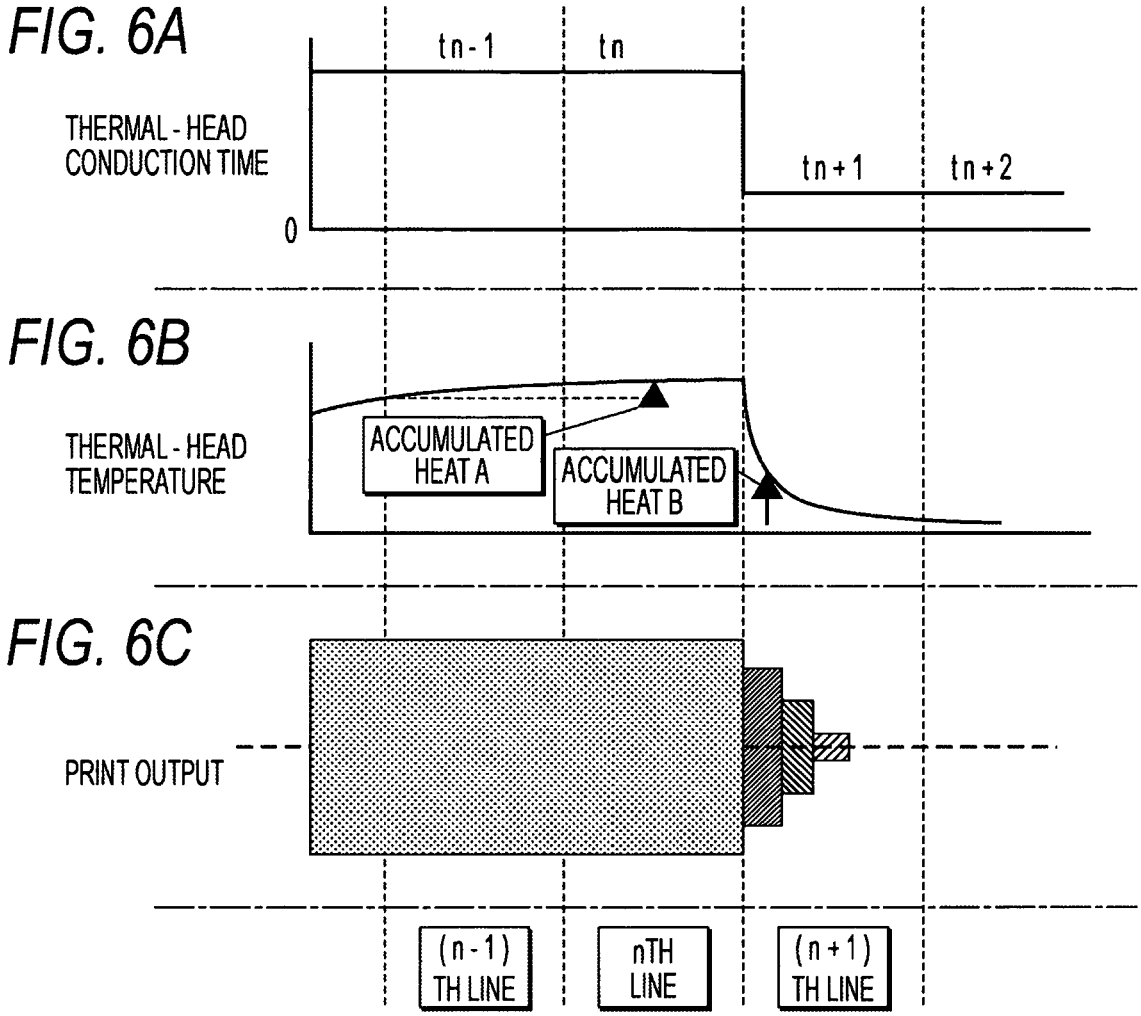
FIGS. 6A-6C are conceptual diagrams in the case where accumulated heat is not corrected.
Figures 7A, 7B, 7C:
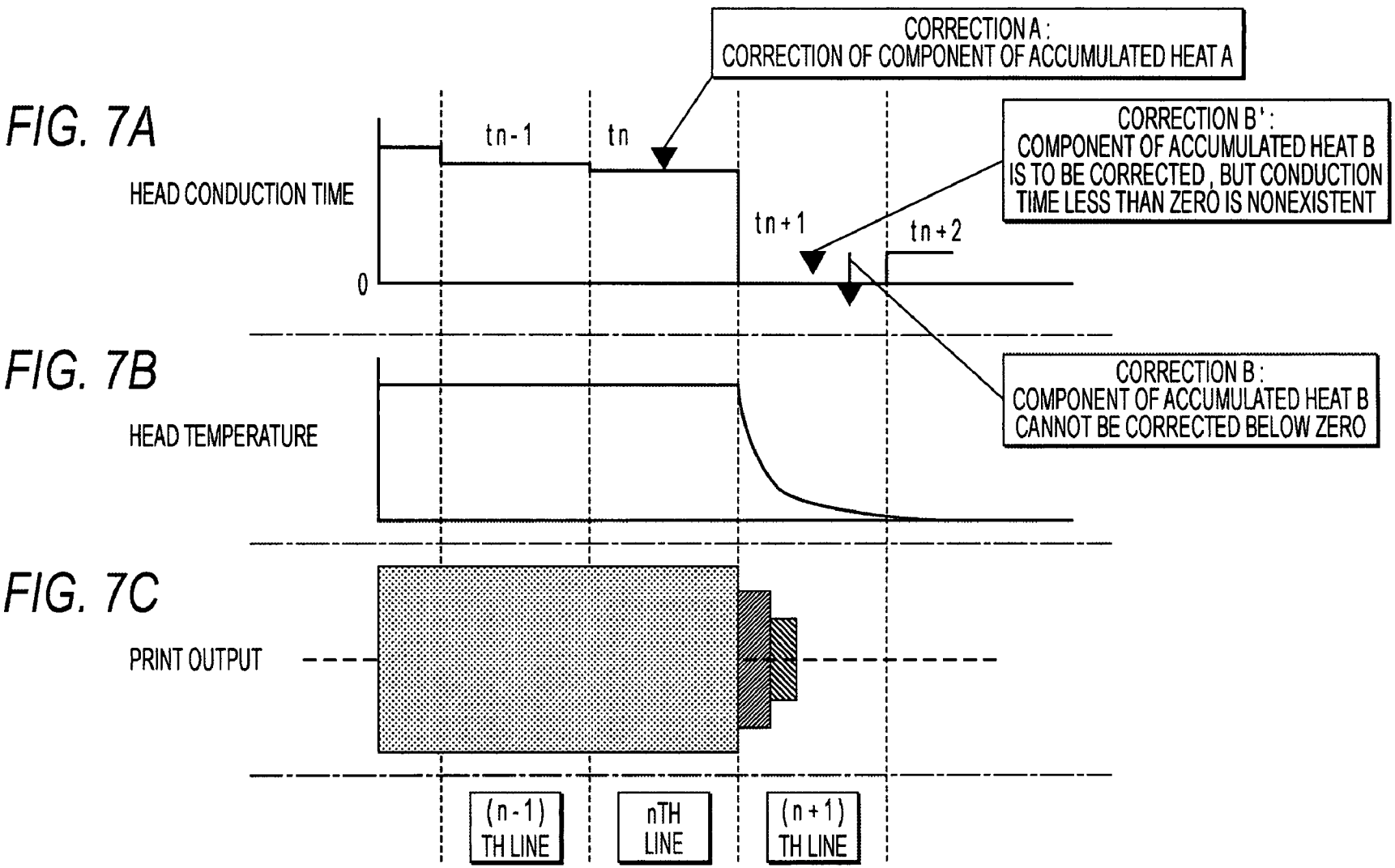
FIGS. 7A-7C are conceptual diagrams in the case where a prior-art accumulated-heat correction is made.

FIG. 5 is an explanatory diagram showing a print area obtained by the accumulated-heat correction method according to the embodiment of this invention, in comparison with a prior-art example. In the prior-art example, a tailing magnitude is large even when the print time period is made zero at the next line. In contrast, in the case of applying this invention, the print time period is subtracted from the preceding line beforehand, and hence, the tailing magnitude becomes small.

As described above, this invention consists in an accumulated-heat correction apparatus for a thermal head 9, wherein the print data of each line are outputted to the thermal head 9, and the conduction time of the thermal head 9 is controlled on the basis of the print data, including cumulative-data calculation means for calculating cumulative data which is ascribable to the accumulated heat of the thermal head 9 up to a previous line (n−1), next-line data calculation means for calculating the print data of a next line (n+1), correction-data generation means for calculating correction data ΔTs which corrects the print data of a current line n, by using the cumulative data and next-line data, and head control means for controlling the conduction time of the thermal head 9 on the basis of the correction data ΔTs generated by the correction-data generation means. With a thermal hysteresis correction in the prior art, in case of making the thermal hysteresis correction of the conduction time of a current line, an accumulated heat quantity is predicted from input data up to the current line and is corrected, and hence, there has been the problem that the current line cannot be corrected when the calculated result of the conduction time becomes greater than the maximum of an available conduction time or less than the minimum thereof. In contrast, according to this invention configured as stated above, an intended density can be attained at the next line (n+1) having been uncorrectable, though the density of the current line n fluctuates to some extent. Besides, intended print densities can be attained for both the current line n and the next line (n+1) by adjusting the magnitude of reflection on the current line n.

Various modifications and alterations of this invention will be apparent to those skilled in the art without departing from the scope and spirit of this invention, and it should be understood that this invention is not limited to the illustrative embodiment set forth herein.

What is claimed is:

1. An accumulated-heat correction apparatus for a thermal head, wherein print data of each line are outputted to the thermal head, and a conduction time of the thermal head is controlled on the basis of the print data, comprising:

cumulative-data calculation means for calculating cumulative data which is ascribable to accumulated heat of the thermal head up to a previous line;

next-line data calculation means for calculating print data of a next line;

correction-data generation means for calculating correction data which corrects print data of a current line, by using the cumulative data and the next-line data; wherein when a conduction time of the value of the print data of the next line is greater than the maximum of the available conduction time or less than the minimum thereof, the correction-data generation means calculates a correction accumulated-heat magnitude by subtracting an uncorrectable component of the conduction time of the next line from a conduction time of the current line; and head control means for controlling the conduction time of the thermal head on the basis of the correction accumulated-heat magnitude.

2. An accumulated-heat correction apparatus for a thermal head as defined in claim 1, wherein the correction-data generation means predicts a correction magnitude at the next line, and it adjusts the correction data of the current line in a case where the predicted magnitude is greater than a maximum of an available conduction time or less than a minimum thereof.

3. An accumulated-heat correction method for a thermal head, wherein print data of each line are outputted to the thermal head, and a conduction time of the thermal head is controlled on the basis of the print data, comprising the steps of:

calculating cumulative data which is ascribable to accumulated heat of the thermal head up to a previous line, and also calculating print data of a next line;

calculating correction data which corrects print data of a current line, by using the cumulative data and the next-line data;

calculating a correction accumulated-heat magnitude by substracting an uncorrectable component of a conduction of the value of the print data of the time of the next line from a conduction time of the current line, when the conduction time of next line is greater than the maximum of the available conduction time or less than the minimum thereof; and controlling the conduction time of the thermal head on the basis of the correction accumulated-heat magnitude.

4. An accumulated-heat correction method for a thermal head as defined in claim 3, wherein in calculating the correction data of the current line, a correction magnitude at the next line is predicted, and the correction data of the current line is adjusted in a case where the predicted magnitude is greater than a maximum of an available conduction time or less than a minimum thereof.

* * * * *